US007980298B2

(12) United States Patent
Halse

(10) Patent No.: US 7,980,298 B2
(45) Date of Patent: Jul. 19, 2011

(54) WEDGE DEVICE

(75) Inventor: Helge-Ruben Halse, Kristiansand (NO)

(73) Assignee: V-Tech AS, Kristiansand (NO)

( * ) Notice: Subject to any disclaimer, the term of this patent is extended or adjusted under 35 U.S.C. 154(b) by 141 days.

(21) Appl. No.: 12/089,019

(22) PCT Filed: Apr. 26, 2007

(86) PCT No.: PCT/NO2007/000146

§ 371 (c)(1),
(2), (4) Date: Apr. 2, 2008

(87) PCT Pub. No.: WO2007/126319

PCT Pub. Date: Nov. 8, 2007

(65) Prior Publication Data

US 2008/0216999 A1 Sep. 11, 2008

(30) Foreign Application Priority Data

Apr. 27, 2006 (NO) ..... 20061861
Sep. 25, 2006 (NO) ..... 20064321

(51) Int. Cl.
*E21B 19/10* (2006.01)

(52) U.S. Cl. ..... 166/75.14; 166/77.1; 175/423

(58) Field of Classification Search ..... 166/77.1, 166/75.14, 77.53; 175/170, 195, 423; 464/163; 173/166, 167

See application file for complete search history.

(56) References Cited

U.S. PATENT DOCUMENTS

| | | | | | |
|---|---|---|---|---|---|
| 3,472,535 | A | * | 10/1969 | Kinley | 285/123.11 |
| 4,505,614 | A | * | 3/1985 | Anschutz | 405/195.1 |
| 4,715,456 | A | * | 12/1987 | Poe et al. | 175/423 |
| 4,934,869 | A | * | 6/1990 | Brandon et al. | 405/199 |
| 5,848,647 | A | | 12/1998 | Webre et al. | |
| 5,992,801 | A | * | 11/1999 | Torres | 248/49 |
| 6,089,338 | A | | 7/2000 | Bouligny, Jr. | |
| 6,223,629 | B1 | | 5/2001 | Bangert | |
| 6,394,201 | B1 | | 5/2002 | Feigel, Jr. et al. | |
| 6,640,939 | B2 | * | 11/2003 | Buck | 188/67 |
| 7,395,855 | B2 | * | 7/2008 | Ayling | 166/77.52 |

FOREIGN PATENT DOCUMENTS

| | | |
|---|---|---|
| NO | 300390 | 1/1996 |
| RU | 2253000 | 12/2004 |

OTHER PUBLICATIONS

Norway Patent Office - , "Written Opinion of the International Search Authority," Norway Patent Office, (Jul. 17, 2007).

* cited by examiner

*Primary Examiner* — Kenneth Thompson
(74) *Attorney, Agent, or Firm* — GableGotwals

(57) ABSTRACT

A wedge device for clamping of pipes and tools during petroleum production, this wedge device comprising an annular mounting element arranged for connection to a deck or a rotary table, where a plurality of man wedges, with associated clamps and displaceable with respect to the annular mounting element, encircle the vertical central axis of the wedge device, and where the clamp is located on an auxiliary wedge displaceably or rotatably coupled to the main wedge.

16 Claims, 5 Drawing Sheets

III-III

V–V

VI-VI

WEDGE DEVICE

CROSS-REFERENCE TO RELATED APPLICATIONS

This application is based on PCT Patent Application No. NO2007/000146, filed on Apr. 26, 2007, which was based on Norwegian Patent Application Nos. 20061861, filed on Apr. 27, 2006 and 20064321, filed on Sep. 25, 2006.

BACKGROUND OF THE INVENTION (1) Field of the Invention

This invention regards a wedge device. More particularly, it regards a wedge device for clamping of pipes and tools during petroleum production. The wedge device comprises an annular mounting element arranged to be connected to a deck or a rotary table, and a plurality of main wedges with associated clamps, displaceable with respect to the annular mounting element, and which encircle the vertical central axis of the wedge device. Each clamp is located on an auxiliary wedge displaceably coupled to the main wedge.

Traditionally, drill rigs of the type used in petroleum production use a wedge device to suspend pipes, typically in the rig drill floor.

According to prior art it is common to make use of so-called slips which are placed in a tapered ring, and which are arranged to grip a pipe when the pipe and the slips are displaced downward in the tapered ring.

It is also known to make use of hydraulically actuated clamps to suspend pipes.

A common feature of these known solutions is the frequent need, brought on by the uncertainty of the operation, for a safety clamp to grip the pipe in the event that the slips or the hydraulically pretensioned clamps slip along the pipe. Devices according to prior art are often adapted a relatively narrow range of pipe dimensions. Thus it is necessary to have access to a number of different components in order to be able to work for instance on pipes having different diameter.

It is also difficult for the slips to take up any torque before a significant vertical load has been placed on them.

The object of the invention is to remedy or reduce at least one of the drawbacks of prior art. The object is achieved, in accordance with the invention, through the characteristics stated in the description below and in the following claims.

(2) Description of Related Art Including Information Disclosed Under 37 CFR 1.97 and 1.98

Not Applicable.

BRIEF SUMMARY OF THE INVENTION

A wedge device in accordance with the invention for clamping of pipes and tools during petroleum production, the wedge device comprising an annular mounting element arranged to be connected to a deck or a rotary table, and where a plurality of main wedges, with associated clamps and displaceable with respect to the annular mounting element, encircle the vertical central axis of the wedge device, is characterized in that the clamps are located on an auxiliary wedge displaceably or rotatably coupled relative to the main wedge.

Advantageously the main wedges are individually hydraulically actuable, and the angle between the central axis and the direction of displacement of the main wedge is selected so that the difference between the spacing of the clamps in the retracted, open position and the spacing of the clamps in the extended, closed position, is acceptable, while at the same time preventing inadvertent outward displacement of the main wedges in the event of a loss of hydraulic pressure to the hydraulic actuators.

The angle between the central axis and the direction of displacement of the auxiliary wedge is selected so as to ensure that the auxiliary wedges are pulled downwards in the main wedges by the weight of a pipe positioned in the clamps.

Thus the angle between the central axis and the direction of displacement of the auxiliary wedge is typically smaller than the angle between the central axis and the direction of displacement of the main wedge.

The angle between the central axis and the direction of displacement of the main wedge will have to be between 0 and 60 degrees, an angle of between 5 and 30 degrees between the central axis and the direction of displacement of the auxiliary axis showing good results, depending on the application. The angle between the central axis and the direction of displacement of the auxiliary wedge will have to be between 0 and 30 degrees, an angle of between 1 and 10 degrees between the central axis and the direction of displacement of the auxiliary axis showing good results, depending on the application.

A spring is connected between the auxiliary wedge and the main wedge. The spring is arranged to transfer vertical forces from the auxiliary wedge to the main wedge. Compressing the spring will displace the auxiliary wedge relative to the main wedge in the event of e.g. a loss of hydraulic pressure. Following disengagement of the clamps, the spring will displace the auxiliary wedge to its initial position with respect to the main wedge.

The constructional design of the wedge device means that the wedge device can operate within a relatively large range of pipe diameters without requiring a change-out of components in the wedge device. The design comprising double wedges in the form of main wedges and co-operating auxiliary wedges prevents the pipe from slipping in the wedge device in the event of a loss of hydraulic pressure.

Controlling the wedges interlocked and in groups will also ensure that the pipe is not inadvertently released, for instance when the pipe has a relatively low weight, thereby eliminating the need for an extra safety clamp around the pipe.

BRIEF DESCRIPTION OF THE DRAWINGS

In the following there is described a non-limiting example of a preferred embodiment illustrated in the accompanying drawings, in which.

DETAILED DESCRIPTION OF THE INVENTION

Figure 1:
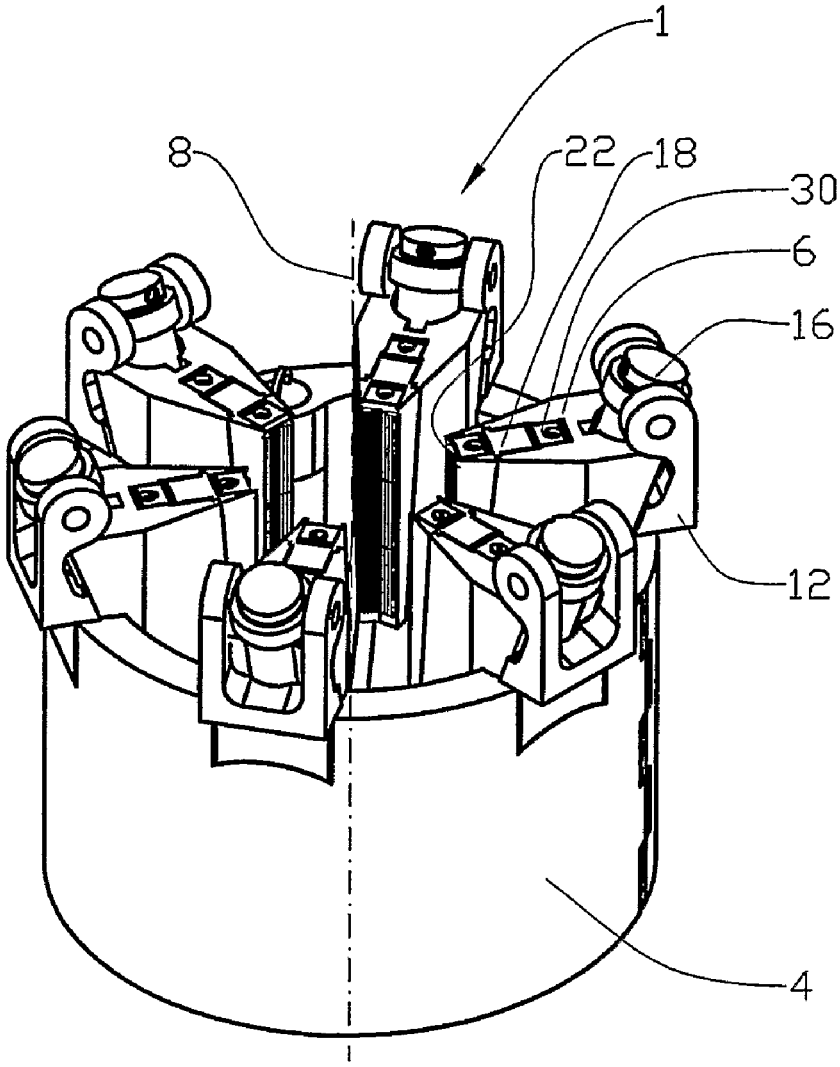
FIG. 1 is a perspective view of a wedge device according to the invention.
Figure 2:
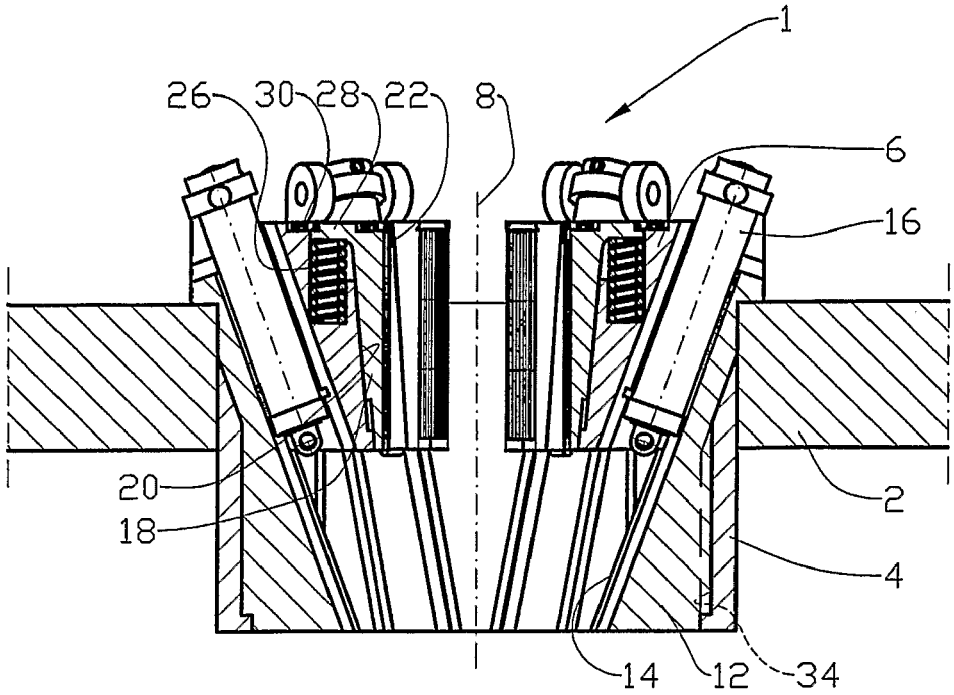
FIG. 2 is a vertical section III-III through the wedge device in FIG. 3, with the wedges in a retracted position.

In the drawings, reference number 1 denotes a wedge device positioned in a deck 2, and which comprises an annular mounting element 4 and a plurality of main wedges 6 encircling the vertical axis 8 of the wedge device 1.

The annular mounting element 4 connected to the drill floor 2 consists of two pieces and is provided with connecting bolts 10. Thus the annular mounting element 4 is arranged to be opened if so required.

Each main wedge 6 is displaceably coupled to a mounting block 12, typically by a main guide 14. The main guide 14 makes an angle a with the central axis 8, see FIG. 6. In this preferred exemplary embodiment, the angle a is 20 degrees.

Figure 3:
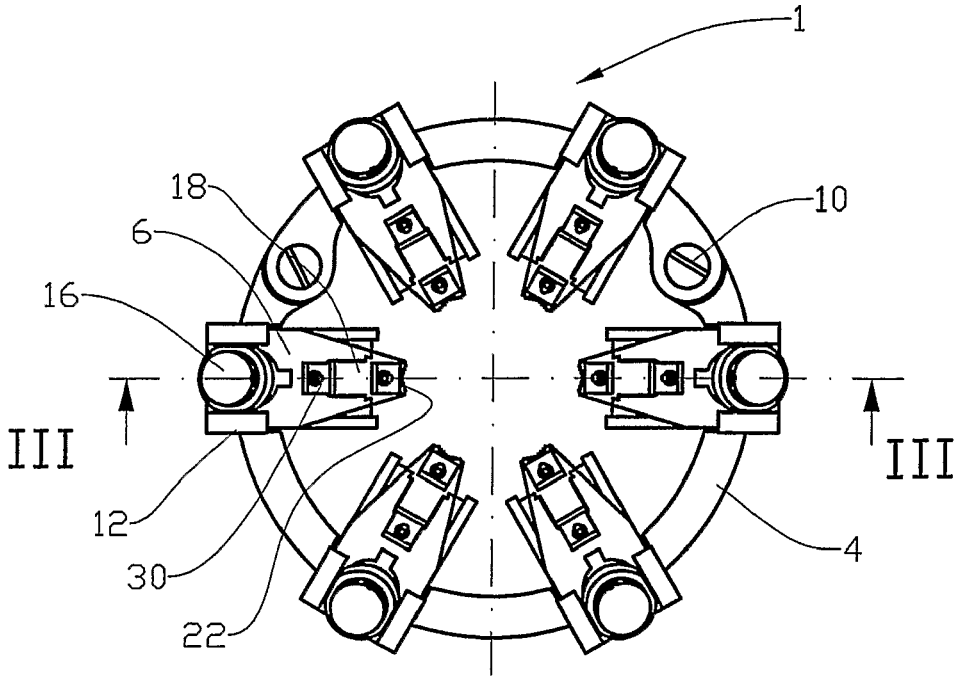
FIG. 3 is a plan view of the wedge device in FIG. 2.
Figure 4:
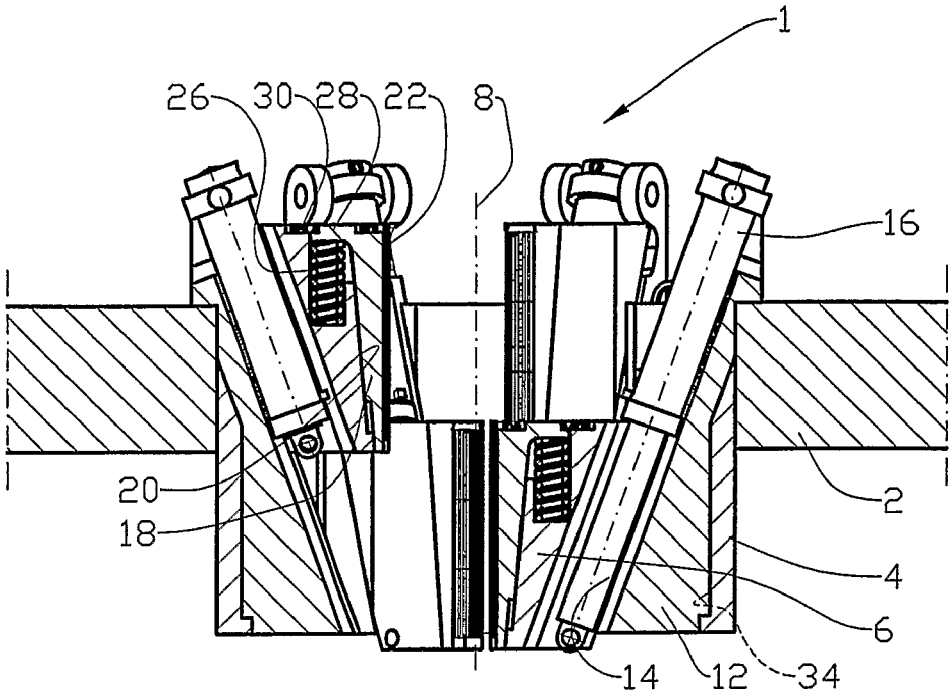
FIG. 4 is a vertical section V-V through the wedge device in FIG. 5, with three of the wedges in a fully extended position.
Figure 5:
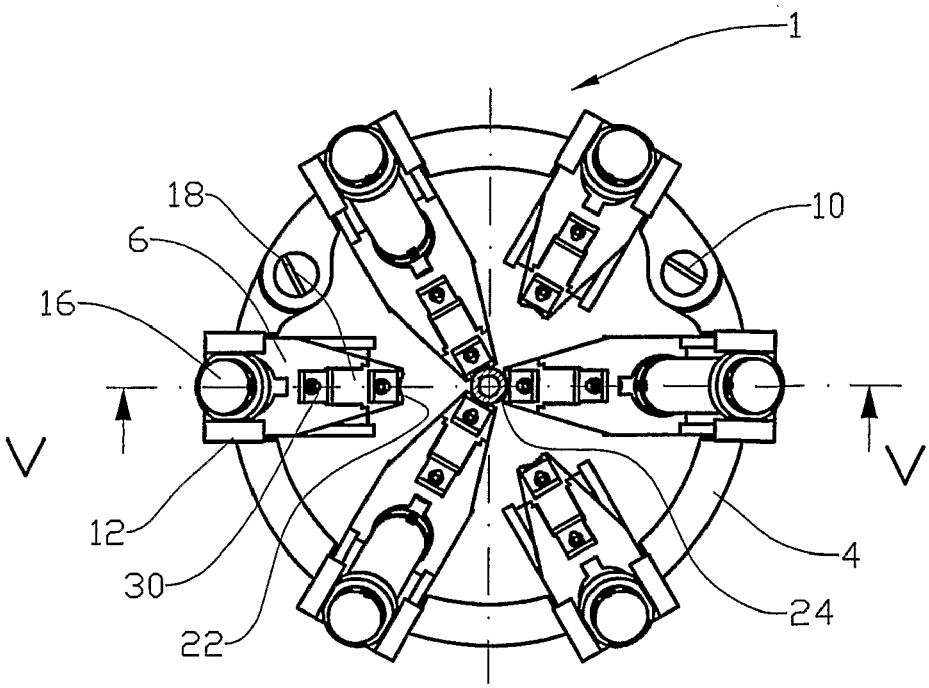
FIG. 5 is a plan view of the wedge device in FIG. 4.

A hydraulic cylinder 16 is connected in an articulated manner between the upper portion of the mounting block 12 and the main wedge 6. The hydraulic cylinder 16 is connected to a hydraulic control system (not shown) by hose and pipe connections (not shown), and is arranged in a controlled and synchronous fashion to move the main wedge 6 along the main guide 14, between a retracted, open position, see FIG. 3, and an extended, closed position, see FIG. 5.

Figure 6:
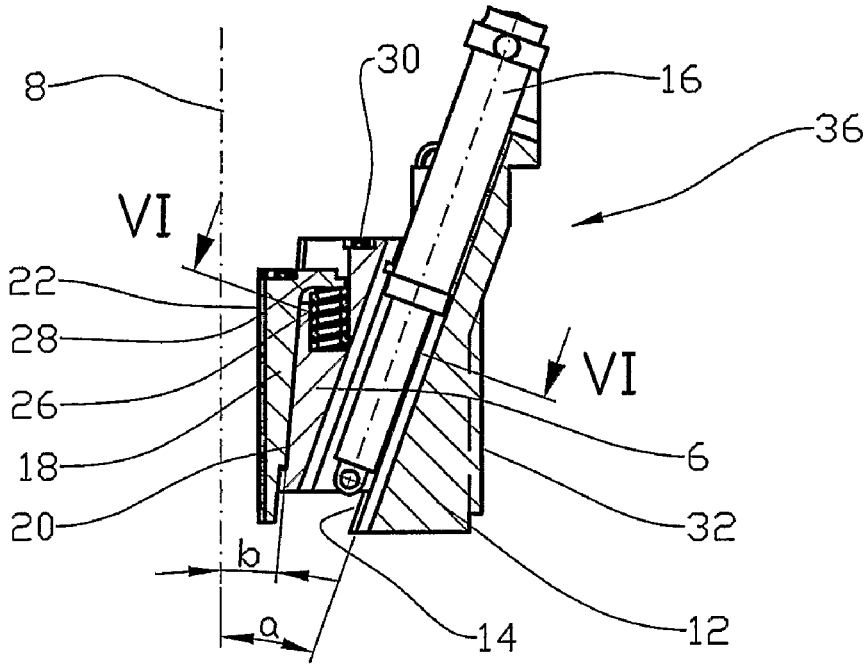
FIG. 6 is a vertical section through a wedge assembly.

An auxiliary wedge 18 is displaceably coupled to the main wedge 6 by an auxiliary guide 20, the auxiliary guide making an angle b with the central axis 8, see FIG. 6. In this preferred exemplary embodiment, the angle b is 5 degrees.

On the side facing the central axis 8, the auxiliary wedge 18 is provided with a clamp 22. The clamp 22 is shaped to firmly engage a pipe 24 located in the gripping device 1, see FIG. 5. The clamp 22 may consist of a separate material, or it may be an integral part of the auxiliary wedge 18.

Both the main guide 14 and the auxiliary guide 20 are designed to take up torque.

The main wedge 6 is provided with a compression spring 26 projecting essentially in parallel with the central axis 8, against a shoulder 28 on the auxiliary wedge 18. Thus the compression spring 26 transfers forces from the auxiliary wedge 18 to the main wedge 6.

When the auxiliary wedge 18 is displaced in the direction of the spring 26 force, the shoulder 28 stops against a wedge lock 30 at the opposite side relative to the compression spring 26. Thus the wedge lock 30 prevents the auxiliary wedge 18 from being displaced out of its auxiliary guide 20.

The auxiliary wedge 18 is also prevented from displacing out of the auxiliary guide 20 in the downward direction.

Figure 7:
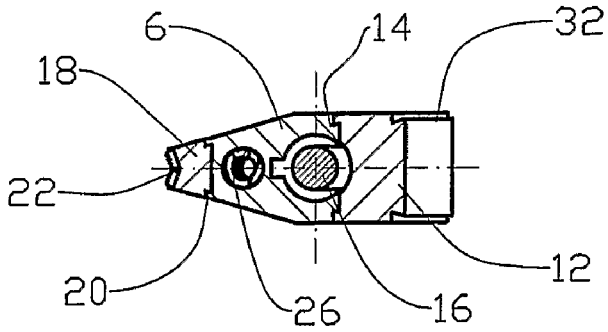
FIG. 7 is a section VI-VI through FIG. 6.
Figure 8:
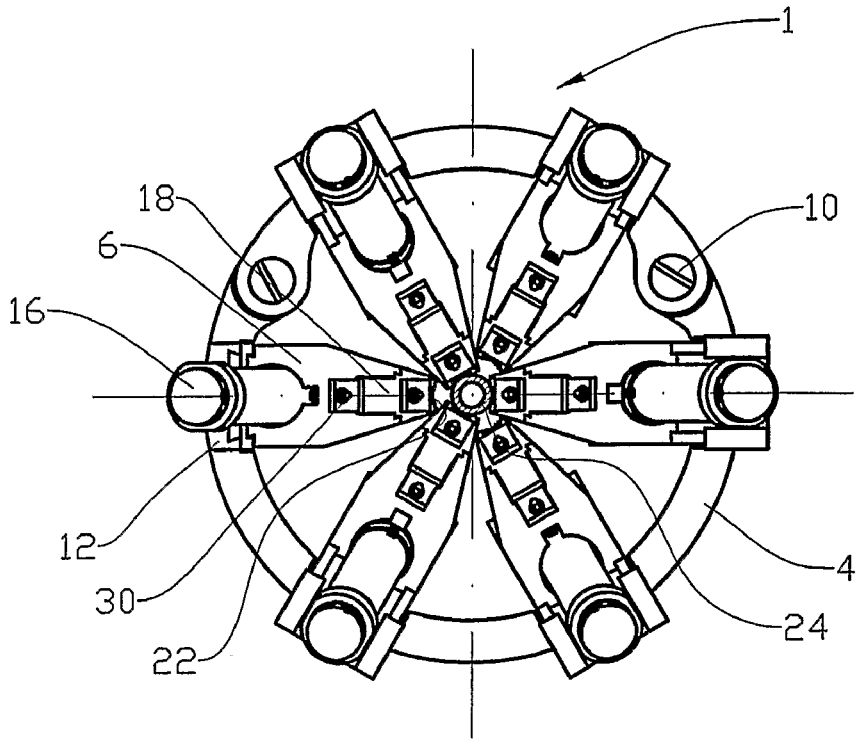
FIG. 8 is a plan view of the wedge device, with three wedges pretensioned against three other wedges.

The mounting block 12 is provided with a dovetail 32, see FIG. 7, which is a complementary fit to a dovetail groove 34 in the annular mounting element 4.

The mounting block 12, the main wedge 6, the auxiliary wedge 18 and the hydraulic cylinder 16 form parts of a wedge assembly 36 which is quite easily replaced by using the dovetail joint 32, 34. This is particularly advantageous in connection with completion and intervention operations in a petroleum well.

In the preferred embodiment, the wedge device 1 is arranged to grip pipes ranging from a diameter of 60 mm (2⅜") to a daylight opening of 330 mm (13") without requiring a change of wedge assemblies 36. Another set of wedge assemblies 36 covers the range from a diameter of 241 mm (9.5") to a daylight opening of 483 mm (19").

To grip a pipe 24, three or six main wedges 6, all depending on the pipe dimensions, are synchronously displaced towards the pipe 24 by respective hydraulic cylinders 16, whereby the clamps 22 grip around the pipe 24. The synchronous extension of the main wedges 6 causes the clamps 22 to clamp the pipe 24 in a central position in the wedge device 1.

If the pipe 24 is of a relatively small diameter, there is only room for three clamps 22 up against the pipe 24. The remaining main wedges 6 are still moved into abutment against the gripping main wedges. The control mechanism (not shown) is connected up in a manner such that an operating error will result in only three clamps being released, thus preventing inadvertent release of the pipe 24, which could fall into e.g. a well (not shown).

In the event of a loss of hydraulic pressure to the cylinders 16, the auxiliary cylinders 18 will still be pulled downwards in the main wedges 6 due to the weight of the pipe 24 suspended from the clamps 22, thus gripping around the pipe 24 with an even stronger grip.

In an alternative embodiment the auxiliary wedge is constituted by an eccentrically supported pivot wedge 38 which can be rotated about a shaft 40. The mode of operation of the pivoted wedge, relative to the main wedge 6, is the same as that described above, the pitch of the pivot wedge 38 being indicated by reference c in FIG. 9.

Figure 9:
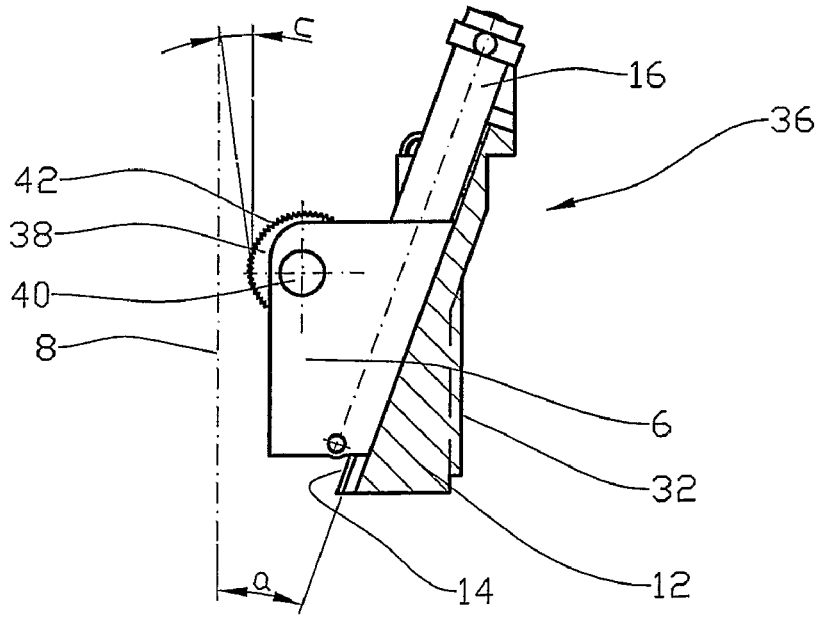
FIG. 9 illustrates an alternative embodiment in which the auxiliary wedges are constituted by eccentrically supported pivoted wedges.

The pivot wedge is provided with a gripping surface 42 arranged to grip the pipe 24. FIG. 9 does not show the pipe 24. A downward force from the pipe 24 will seek to rotate the pivot wedge 38 into an even tighter engagement with the pipe 24. The pivot wedge 38 can be made up of several coordinate plates.

The invention claimed is:

1. A wedge device for clamping of pipes and tools during petroleum production, the wedge device comprising;

an annular mounting element;

a plurality of main wedges displaceable with respect to the annular mounting element, and encircling a vertical central axis of the wedge device;

an auxiliary wedge coupled relative to the main wedge; and a clamp is located on the auxiliary wedge wherein said plurality of main wedges has a first set of wedges and at least a second set of wedges, said first and second set of wedges being arranged at the same level on the annular mounting element, and wherein the first set of wedges is operable for clamping the pipe independent of said second set of wedges.

2. A wedge device in accordance with claim 1, further comprising said auxiliary wedge being displaceably coupled to said main wedge.

3. A wedge device in accordance with claim 1, further comprising an angle between said central axis and a direction of displacement of said main wedge is between 5 and 30 degrees.

4. A wedge device in accordance with claim 1, further comprising an angle between said central axis and a direction of displacement of said auxiliary wedge is between 0 and 30 degrees.

5. A wedge device in accordance with claim 1, further comprising an angle between said central axis and a direction of displacement of said auxiliary wedge is between 1 and 10 degrees.

6. A wedge device in accordance with claim 1, further comprising said main wedge being hydraulically actuated.

7. A wedge device in accordance with claim 1, further comprising a spring connected between said auxiliary wedge and said main wedge, said spring being arranged to transfer forces from said auxiliary wedge to said main wedge.

8. A wedge device in accordance with claim 1, further comprising a wedge lock and a guide, said wedge lock being arranged to prevent said auxiliary wedge from being displaced out of said guide.

9. A wedge device in accordance with claim 1, further comprising an angle between said central axis and a direction of displacement of the auxiliary wedge is smaller than an angle between said central axis and a direction of displacement of said main wedge.

10. A wedge device in accordance with claim 1, further comprising an angle between said central axis and a direction of displacement of said main wedge is between 0 and 60 degrees.

11. A wedge device in accordance with claim 1, wherein the first set of wedges can grip a pipe having a diameter smaller than a diameter defined by the clamps on both sets of auxiliary wedges abutting each other.

12. A wedge device for clamping of pipes and tools during petroleum production, the wedge device comprising:

an annular mounting element;

a plurality of main wedges displaceable with respect to the annular mounting element, and encircling a vertical central axis of the wedge device;

an auxiliary wedge coupled relative to the main wedge; and a clamp is located on the auxiliary wedge wherein said main wedge running along a main guide in a mounting block, said mounting block being provided with a dovetail which is a complementary fit to a dovetail groove in the annular mounting element.

13. A wedge device in accordance with claim 12, further comprising said wedge device is provided with at least two sets of interchangeable wedge assemblies wherein a first set being arranged for gripping pipes having a diameter within a first range and a second set being arranged for gripping pipes having a diameter within a second range.

14. A wedge device for clamping of pipes and tools during petroleum production, the wedge device comprising an annular mounting element;

a plurality of main wedges displaceable with respect to the annular mounting element, and encircling a vertical central axis of the wedge device;

an auxiliary wedge coupled relative to the main wedge; and wherein said plurality of main wedges has a first set of wedges and at least a second set of wedges, said first and second set of wedges being arranged at the same level on the annular mounting element, and wherein the first set of wedges is operable for clamping the pipe independent of said second set of wedges and said auxiliary wedge being rotatably coupled to said main wedge.

15. A wedge device for clamping of pipes and tools during petroleum production, the wedge device comprising:

an annular mounting element;

a plurality of main wedges displaceable with respect to the annular mounting element, and encircling a vertical central axis of the wedge device;

an auxiliary wedge coupled relative to the main wedge; and a clamp is located on the auxiliary wedge wherein said main wedges are individually actuable; and wherein said plurality of main wedges has a first set of wedges and at least a second set of wedges, said first and second set of wedges being arranged at the same level on the annular mounting element, and wherein the first set of wedges is operable for clamping the pipe independent of said second set of wedges.

16. A wedge device for clamping of pipes and tools during petroleum production, the wedge device comprising:

an annular mounting element;

a plurality of main wedges displaceable with respect to the annular mounting element, and encircling a vertical central axis of the wedge device;

an auxiliary wedge coupled relative to the main wedge;

a clamp is located on the auxiliary wedge wherein less than all of said main wedges are arranged for synchronously gripping the pipe; and a remaining number of said total number of main wedges not gripping the pipe are arranged to abut against at least three main wedges gripping the pipe.

* * * * *